United States Patent [19]

Kolesinski et al.

[11] 4,080,206

[45] Mar. 21, 1978

[54] PHOTOGRAPHIC PROCESSING COMPOSITION CONTAINING POLYVINYL AMINIMIDE

[75] Inventors: Henry S. Kolesinski, Burlington; Lloyd D. Taylor, Lexington, both of Mass.

[73] Assignee: Polaroid Corporation, Cambridge, Mass.

[21] Appl. No.: 686,165

[22] Filed: May 13, 1976

Related U.S. Application Data

[63] Continuation-in-part of Ser. No. 537,123, Dec. 30, 1974, abandoned.

[51] Int. Cl.[2] ..... G03C 5/54; G03C 7/00; G03C 1/48; G03C 1/40

[52] U.S. Cl. ..... 96/29 R; 96/3; 96/29 D; 96/61 R; 96/61 M; 96/66 R; 96/76 R; 96/76 C; 96/77

[58] Field of Search ..... 96/3, 29 D, 29 R, 76 C, 96/76 R, 77, 66 R, 61 M, 61 R

[56] References Cited

U.S. PATENT DOCUMENTS

| | | | |
|---|---|---|---|
| 3,527,802 | 9/1970 | Slagel et al. | 260/561 H |
| 3,641,145 | 2/1972 | Culhertson et al. | 260/558 H |
| 3,647,437 | 3/1972 | Land | 96/3 |
| 3,704,128 | 11/1972 | Koda et al. | 96/61 R |

*Primary Examiner*—David Klein
*Assistant Examiner*—Richard L. Schilling
*Attorney, Agent, or Firm*—Philip G. Kiely

[57] ABSTRACT

Diffusion transfer products and processes are disclosed wherein the processing composition includes, as the viscosity increasing component thereof, a polymer containing recurring groups of the formula:

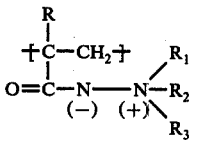

wherein R is hydrogen, alkyl or halogen; $R_1$ is alkyl; $R_2$ and $R_3$ each are alkyl, aryl or alkaryl or $R_2$ and $R_3$ together may comprise an alkylene group to form a heterocyclic ring with the nitrogen.

17 Claims, No Drawings

PHOTOGRAPHIC PROCESSING COMPOSITION CONTAINING POLYVINYL AMINIMIDE

CROSS-REFERENCE TO OTHER APPLICATIONS

This applicaton is a continuation-in-part of application Ser. No. 537,123, filed Dec. 30, 1974, now abandoned.

BACKGROUND OF THE INVENTION

The present invention is concerned with photography and, more particularly, with diffusion transfer processes.

The present invention is especially related to silver and color diffusion transfer process of the type wherein a transfer image is obtained in a single step by treating an exposed photosensitive element with a layer of a suitable processing solution to provide, as a function of development, an imagewise distribution of image-forming components, and transferring at least a portion of the image-wise distribution of image-forming components to a superposed image-receiving layer to form a transfer image thereon.

In silver diffusion processes, an exposed photosensitive silver halide emulsion is developed and almost concurrently therewith a soluble silver complex is obtained by reaction of a silver halide solvent with the unexposed and undeveloped silver halide of said emulsion. Preferably, the photosensitive silver halide emulsion is wet with a layer of processing composition which is spread between the photosensitive element comprising the silver halide emulsion and an image-receiving element. The processing composition effects development of the latent image in the emulsion and substantially contemporaneous therewith forms a soluble silver complex, for example, a thiosulfate, with undeveloped slver halide. This soluble silver complex is, at least in part, transferred to the image-receiving element and the silver thereof is largely precipitated thereon to form the transfer image.

In color diffusion transfer processes, a photosensitive element including a silver halide emulsion layer is exposed to create therein a latent image. The latent image is developed and, concurrent with and under the control of this development, an imagewise distribution of mobile color-providing substances is formed. At least a portion of these color-providing substances of image dyes or image dye intermediates is transferred to a superposed image-receiving layer to form a colored image thereon. As examples of such processes, mention may be made of the processes disclosed and claimed in U.S. Pat. No. 2,983,606, wherein dye developers (i.e., compounds which contain in the same molecule both the chromophoric system of a dye and also a silver halide developing function) are the color-providing substances, the processes disclosed and claimed in U.S. Pat. No. 2,647,049, issued July 28, 1953, to Edwin H. Land, wherein color developers are employed to develop the latent image and color couplers are the color-providing substances, and the processes disclosed in U.S. Pat. No. 3,087,817 issued Apr. 30, 1963, to Howard G. Rogers, wherein complete, preformed dyes are used as the color-providing substances and the processes disclosed in U.S. Pat. No. 3,443,940, issued May 19, 1969 to Stanley M. Bloom and Howard G. Rogers, wherein a compound which is immobile and non-diffusible in the processing fluid, but which, upon development of the emulsion, undergoes a ring-closing reaction to split off a mobile and diffusible color-providing material which is transferred to a dyeable stratum.

In the most commonly employed method for carrying out such diffusion transfer processes, a layer of the processing solution is applied between the photosensitive element and a superposed image-receiving element, and the imagewise distribution of image-forming components is transferred through the layer of processing solution to the image-receiving layer. In particularly useful embodiments, the processing solution is dispensed between th photosensitive element and the image-receiving element from a rupturable container such as disclosed in U.S. Pat. No. 2,543,181, by moving said container between a pair of pressure rollers such as provided in cameras such as disclosed in U.S. Pat. Nos. 2,435,717 and 3,165,0369. In especially useful embodiments, the processing solution comprises a polymeric viscosity-increasing reagent to facilitate the spreading of the solution between the photosensitive element and the image-receiving element. Such reagents generally serve to slow down the flow rate of the processing solution so that it can be more uniformly controlled and distributed between the superposed negative and image-receiving element.

Generally, the polymeric viscosity-increasing reagents which are used in the above embodiments are soluble in aqueous alkaline solutions and are inert with respect to the photographic reagents which may be present, e.g., developers, antifoggants, alkali, silver halide solvents, etc. In the past, water-soluble hydroxy-substituted polymers have been found useful. In especially useful embodiments, hydroxyalkyl ethers of cellulose, such as hydroxyethyl cellulose have been employed, as well as carboxymethyl cellulose, as is disclosed in U.S. Pat. No. 2,603,565, issued July 15, 1965, to Edwin H. Land, and which is incorporated herein by reference.

As is well known in the art, the aforementioned photographic reagents may be present in the processing composition or disposed in the film unit. Therefore, the photographic processing composition is adapted to provide, upon contact with the exposed photosensitive layer, as a function of development, an image distribution of image forming components, either by carrying the reagents in the processing composition or by the processing composition releasing or activating reagents in the film unit.

In certain instances, however, the viscosity-increasing reagents have inhibited transfer of the image-forming components or have lacked stability with respect to the ability to maintain other components of the processing composition in solution or suspension.

SUMMARY OF THE INVENTION

The present invention is directed to photographic processing compositions containing, as a thickening agent, a polymer containing recurring groups of the formula:

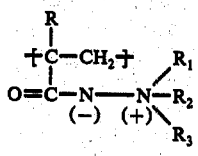

wherein R is hydrogen, alkyl or halogen; $R_1$ is alkyl; $R_2$ and $R_3$ each are alkyl, aryl or alkaryl or $R_2$ and $R_3$ together may comprise an alkylene group, preferably a 4 or 5 carbon alkylene group, to form a heterocyclic ring with the nitrogen. The alkyl groups are preferably 1–4 carbon alkyl groups. The aryl group is preferably phenyl and the alkaryl group an alkyl-substituted phenyl group.

The processing composition of the present invention is particularly suitable for silver and color diffusion transfer processing.

BACKGROUND OF THE INVENTION

The vinyl aminimide polymers of the present invention possess a number of properties which render them particularly suitable for photographic processing liquids:

(1) They are very water-soluble and are not sensitive to "salting out";

(2) They are hydrolytically stable to alkali (boiling 6N KOH for 24 hours without signs of degradation);

(3) They are non-mordants and thus provide no interaction with dyes;

(4) They possess a high degree of dispersing power and thus can maintain pigment components, such as titanium dioxide or carbon black, of the processing liquid in suspension even when subjected to centrifuging.

As examples of suitable vinyl aminimide polymers suitable for use in the present invention, mention may be made of polymers containing the following recurring groups:

1. 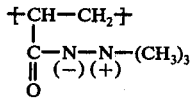

2. 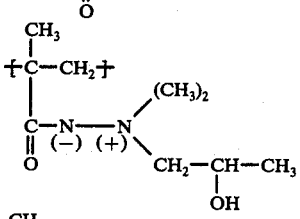

3. 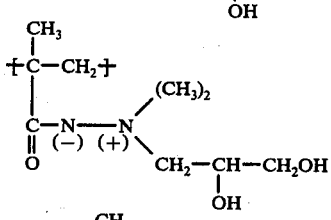

4. 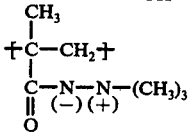

Most vinyl aminimide polymers of the present invention are known to the art. Polymerization may be achieved by free radical polymerization techniques. Additional details regarding preparation of the monomers and formation of the polymers may be found in U.S. Pat. No. 3.527,802, issued Sept. 8, 1970, incorporated by reference herein in its entirety.

The terms "polyvinyl aminimide" and "vinyl aminimide polymers" as used herein is intended to include copolymers of, as well as homopolymers, of the vinyl aminimide with one or more other vinyl monomers which are hydrolytically stable in alkali and not excessively hydrophobic so that the copolymer will not salt out. As examples of such vinyl monomers mention may be made of acrylic acid and 2-acrylamido-2-methyl-propane sulfonic acid.

The following nonlimiting example illustrates the preparation of the polymer and its employment in a photographic processing liquid.

EXAMPLE I

The following materials were placed in a glass vessel:

| | Parts by Weight |
|---|---|
| 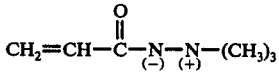 | 1 |
| Water | 9 |
| Azobisisobutyronitrile | 0.001 |

The vessel was flushed with nitrogen, evacuated and sealed under a vacuum. After heating at 65° C. overnight, the polymer, poly-1,1,1-trimethylamine acrylimide, was precipitated into acetone, filtered and dried.

A photographic processing composition was prepared as follows:

| | | |
|---|---|---|
| Potassium hydroxide (1.5N) | 10 | cc. |
| Poly-1,1,1-trimethylamine acrylimide | 0.5 | g. |
| Phenethyl-α-picolinium bromide | 0.172 | g. |
| Benzotriazole | 0.115 | g. |
| Titanium dioxide | 7.5 | g. |

A Polaroid Land SX-70 film unit was exposed and processed through mechanical lab rollers having a 3.0 mil gap employing the above-designated processing composition. A dye image of good quality was formed.

The processing composition was also centrifuged for 10 minutes in a laboratory centrifuge and no settling out of the pigment was observed.

The following nonlimiting examples illustrate the use of the vinyl aminimide polymers in silver diffusion transfer systems.

EXAMPLE II

An exposed film unit constructed according to the teachings of U.S. Pat. No. 3,671,241 and employing a regenerated cellulose image-receiving layer was processed through mechanical lab rollers having a 3.0 mil gap with a processing composition comprising:

| | | |
|---|---|---|
| Poly-1,1,1-trimethylamine acrylimide | 43 | g. |
| Potassium hydroxide (45% solution) | 313 | g. |
| Uracil | 60 | g. |
| N,N-dimethoxyethyl-hydroxylamine | 30 | g. |
| Water | 833 | g. |

After an imbibition period of 60 seconds, the negative was detached from the image-receiving element. A well discriminated positive silver image was obtained.

EXAMPLE III

An exposed of Polaroid Type 107 Land film unit was processed through mechanical lab rollers having a 2.2 mil gap with a processing composition comprising:

| | | |
|---|---|---|
| Poly-1,1,1-trimethylamine acrylimide | 45.5 | g. |
| Sodium sulfite | 30.6 | g. |
| Sodium thiosulfate | 91 | g. |
| Sodium hydroxide | 36 | g. |
| 2-t-butylhydroquinone | 28.4 | g. |
| Water | 825 | g. |

After an imbibition period of 30 seconds, the negative was detached from the image-receiving element. A well discriminated positive image was obtained.

The following nonlimiting example illustrates the preparation of an aminimide copolymer and its employment in a photographic processing liquid.

EXAMPLE IV

The following materials were placed in a glass vessel:

| | Parts by Weight |
|---|---|
| $CH_2{=}CH{-}\overset{O}{\overset{\|}{C}}{-}\underset{(-)}{N}{-}\underset{(+)}{N}{-}(CH_3)_3$ | 2 |
| Acrylic acid | 8 |
| Water | 566 |
| Azobisisobutyronitrile | .001 |
| Potassium hydroxide to give a pH of 4.32 | |

The vessel was flushed with nitrogen, evacuated and sealed under a vacuum. After heating at 65° C overnight, the aminimide/acrylic acid copolymer, a clear viscous solution, was obtained.

A photographic processing composition was prepared as follows:

| | | |
|---|---|---|
| Aminimide/acrylic acid copolmer | 5 | g. |
| Water | 5 | g. |
| Titanium dioxide | 5 | g. |
| Potassium hydroxide (85%) | 920 | mg. |
| Phenethyl-α-picolinium bromide | 256 | mg. |
| Benzotriazole | 165 | mg. |

A Polaroid Land SX-70 film unit was exposed and processed through mechanical lab rollers having a 2.8 mil gap employing the above-designated processing composition. A dye image of good quality was obtained.

The vinyl aminimide polymers within the scope of the present invention may be employed as the sole thickening agent or in conjunction with a second viscosity-increasing agent, such as hydroxyethyl cellulose, carboxymethyl cellulose, carboxymethyl hydroxyethyl cellulose, and the like.

In general, the amount of vinyl aminimide polymers employed in the processing composition will be determined empirically, depending upon the viscosity desired, the suspending properties desired, and the other components of the processing composition.

As stated above, the novel photographic processing composition of the present invention may be employed in a wide variety of film units. As examples of such color film units, mention may be made of U.S. Pat. Nos. 2,983,606; 3,415,644; 3,415,646; 3,594,164; 3,594,165; 3,647,347; 3,615,421; 3,661,585; 3,647,435; 3,473,925; 3,573,042; 3,576,626; 3,573,043; 3,620,724; and 3,647,434.

As examples of such silver transfer film units, mention may be made of U.S. Pat. Nos. 2,726,154; 2,944,894; 3,406,064; 3,565,619; 3,681,072; 3,681,073; 3,698,900; and 3,765,889.

It will be noted that, in addition to the reagents already set forth, the liquid processing composition employed may contain an auxiliary or accelerating developing agent, such as p-methylaminophenol, 2,4-diaminophenol, p-benzylaminophenol, hydroquinone, toluhydroquinone, phenylhydroquinone, 4'-methylphenylhydroquinone, etc. It is also contemplated to employ a plurality of auxiliary or accelerating developing agents, such as 3-pyrazolidone developing agent and a benzenoid developing agent, as disclosed in U.S. Pat. No. 3,039,869, issued June 19, 1962. As examples of suitable combinations of auxiliary developing agents, mention may be made of 1-phenyl-3-pyrazolidone in combination with p-benzylaminophenol and 1-phenyl-3-pyrazolidone in combination with 2,5-bis-ethylenimino-hydroquinone.

The processing composition may also contain onium compounds, particularly quaternary ammonium compounds, preservatives, restrainers, accelerators, and the like.

The concentration of the various components may be varied over a relatively wide range at the option of the operator.

Since certain changes may be made in the above products and processes without departing from the scope of the invention herein involved, it is intended that all matter contained in the above description shall be interpreted as illustrative and not in a limiting sense.

What is claimed is:

1. In a diffusion transfer photographic process wherein an exposed photosensitive silver halide emulsion layer is developed by being treated with a layer of photographic processing composition to provide an imagewise distribution of diffusible image-forming components, at least a portion of which are transferred through said layer of photographic processing composition to a superposed image-receiving layer to form a transfer image therein;

the improvement wherein said photographic processing composition includes a polymer containing recurring groups of the formula:

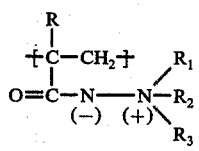

wherein R is hydrogen, alkyl or halogen; $R_1$ is alkyl; $R_2$ and $R_3$ each are alkyl, aryl or alkaryl or $R_2$ and $R_3$ together comprise an alkylene group to form a heterocyclic ring with the nitrogen.

2. The process as defined in claim 1 wherein said image-forming components are dye developers.

3. The process as defined in claim 1 wherein said image-forming components are color couplers.

4. The process as defined in claim 1 wherein said exposed photosensitive silver halide is contacted with a silver halide solvent and said image-forming component is a diffusible silver complex.

5. A process as defined in claim 1 wherein $R_1$, $R_2$ and $R_3$ each are methyl.

6. A process as defined in claim 23 wherein said photographic processing composition includes a quaternary ammonium compound.

7. A process as defined in claim 2 wherein said photographic processing composition includes a silver halide antifoggant.

8. A process as defined in claim 2 wherein said photographic processing composition includes a pigment.

9. A process as defined in claim 4 wherein said photographic processing composition includes a silver halide solvent.

10. A process as defined in claim 1 wherein said photographic processing composition includes a second thickening agent.

11. In a photographic diffusion transfer product comprising a light-sensitive photographic element containing at least one silver halide emulsion layer, a receiving layer for receiving images from said light-sensitive element, and an aqueous alkaline processing composition in a pressure rupturable container wherein said processing liquid is adapted to provide upon contact with an exposed photosensitive layer, as a function of development, an imagewise distribution of image-forming components and said product includes a silver halide developing agent;

the improvement wherein said processing composition includes a polymer containing recurring groups of the formula:

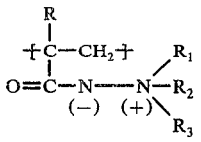

wherein R is hydrogen, alkyl or halogen; $R_1$ is alkyl; $R_2$ and $R_3$ each are alkyl, aryl or alkaryl or $R_2$ and $R_3$ together comprise an alkylene group to form a heterocyclic ring with the nitrogen.

12. The product as defined in claim 11 which includes as image-forming components dye developers.

13. The product as defined in claim 11 which includes as image-forming components color couplers.

14. The product as defined in claim 11 which includes a silver halide solvent.

15. A photographic film unit which comprises a plurality of sequential layers including a first support; a photosensitive silver halide layer having associated therewith a dye image-forming material adapted to provide an imagewise distribution of diffusible image dye or image dye intermediate as a function of the point-to-point degree of silver halide layer exposure to actinic radiation; a layer adapted to receive said diffusible image dye or dye intermediate diffusing thereto; a second support transparent to radiation actinic to the silver halide layer; a rupturable container retaining an alkaline processing composition positioned extending transverse an edge of the film unit, and adapted, upon applicaton of pressure, to release said processing composition for distribution between layers of said film unit with said supports outermost, and a silver halide developing agent, said processing composition including a polymer containing recurring groups of the formula:

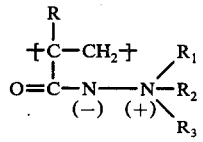

wherein R is hydrogen, alkyl or halogen; $R_1$ is alkyl; $R_2$ and $R_3$ each are alkyl, aryl or alkaryl or $R_2$ and $R_3$ together comprises an alkylene group to form a heterocyclic ring with the nitrogen.

16. A film unit as defined in claim 5 wherein said processing composition includes an opacifying agent.

17. A film unit as defined in claim 16 wherein said opacifying agent comprises titanium dioxide.

* * * * *